US005568752A

United States Patent [19]

Alford

[11] Patent Number: 5,568,752

[45] Date of Patent: Oct. 29, 1996

[54] ADJUSTABLE SPANNER

[75] Inventor: Larry A. G. Alford, Coolbellup, Australia

[73] Assignee: Kwik Wrench Pty Ltd., O'Connor, Australia

[21] Appl. No.: 351,246

[22] PCT Filed: Jun. 3, 1993

[86] PCT No.: PCT/AU93/00262

§ 371 Date: Jan. 25, 1995

§ 102(e) Date: Jan. 25, 1995

[87] PCT Pub. No.: WO93/25350

PCT Pub. Date: Dec. 23, 1993

[30] Foreign Application Priority Data

Jun. 8, 1992 [AU] Australia ..... PL2813

[51] Int. Cl.[6] ..... B25B 13/12

[52] U.S. Cl. ..... 81/126; 81/142

[58] Field of Search ..... 81/126, 127, 136, 81/137, 142, 143

[56] References Cited

U.S. PATENT DOCUMENTS

| | | | |
|---|---|---|---|
| 1,417,756 | 5/1922 | McDonald . | |
| 2,587,320 | 2/1952 | Hogstadius . | |
| 3,376,766 | 4/1968 | Vienat . | |
| 5,050,465 | 9/1991 | Haugs | 81/126 |

FOREIGN PATENT DOCUMENTS

| | | |
|---|---|---|
| 400949 | 4/1966 | Switzerland . |
| WO83/00650 | 3/1983 | WIPO . |

*Primary Examiner*—James G. Smith
*Attorney, Agent, or Firm*—Larson and Taylor

[57] ABSTRACT

This specification discloses an adjustable spanner that has a handle provided with a first jaw at one end. A lever is pivotally connected to the handle and has coupled at one end a second jaw. The jaw is coupled to the lever by a link. The link is pivotally connected at one end to the second jaw and pivotally connected at another end to the lever. A cam is carried in slot formed in link. An elongate slot is cut in a head portion of the handle. As the lever is pivoted with respect to the handle the cam rides in slot and the jaws and move linearly with respect to each other. The cam and slot cooperate to form a locking mechanism. The locking mechanism has a free state corresponding to the cam being disengaged from the slot in which the jaws are able to move relative to each other and the locking state in which the cam engages the slot whereby the jaws are locked against movement away from each other. The locking mechanism remains in the free state until the lever is pivoted in a first direction relative to the handle to a position where the jaws can grip a nut or the like placed therebetween. Upon further movement in the first direction, the lever then operates via the link to rotate the cam into engagement with the slot thereby locking the jaws against movement away from each other. Upon releasing the handle, a return spring rotates the cam in an opposite direction lifting it away from slot so as to return the locking mechanism to the free state.

12 Claims, 4 Drawing Sheets

ADJUSTABLE SPANNER

FIELD OF THE INVENTION

This invention relates to an adjustable spanner.

DISCUSSION OF PRIOR ART

Adjustable spanners are particularly useful because they can accommodate various sizes of nuts, bolts and like. The most common type of adjustable spanner comprises a fixed jaw, and a moveable jaw which is journaled to a worm gear adapted to be rotated by the thumb of a user. Rotation of the worm gear causes the moveable jaw to move relative to the fixed jaw to facilitate gripping of nuts, bolts and the like of various sizes between the jaws. One difficulty with this type of adjustable spanner is that adjusting the spanner to engage a nut of a particular size can be time-consuming, particularly in a confined environment where the nut cannot be seen or where there is insufficient room to allow the user to adjust the spanner in situ. A further inherent difficulty is that the worm gear is designed to leave some play between the jaws. This play can sometimes result in the spanner slipping under pressure.

SUMMARY OF THE INVENTION

The present invention was developed with a view to providing an adjustable spanner which can more readily and quickly be adjusted to the required setting with minimal risk of slippage.

To this end, the present invention provides an adjustable spanner comprising:

a handle provided with a first jaw at one end;

a lever having a second jaw coupled thereto at one end, the lever being pivotally connected to the handle and juxtaposed so that pivotal movement of the lever relative to the handle effects movement of the first jaw relative to the second jaw whereby the first and second jaws can grip an article placed therebetween; and, locking means having a free state in which the jaws are able to move relative to each other and a locking state in which the jaws are locked against movement away from each other, said locking means cooperating with said lever so as to remain in said free state until the lever is pivoted in a first direction relative to the handle to a position where the jaws grip an article placed between the first and second jaws, whereby, upon further movement in said first direction the lever operates to change the state of the locking means to the locking state, thereby locking the jaws against movement away from each other.

Preferably, said locking means comprises first and second mutually engagable elements, said elements being disengaged when the locking means is in the free state and being engaged when the locking means is in the locking state, said first element being associated with said lever so that upon said further movement, said lever operates to effect engagement of said first and second elements.

Preferably, said locking means comprises a link having a first pivot connection to said one end of the lever and a second pivot connection to said second jaw thereby coupling the second jaw to the lever.

Preferably said first element is carried by said link.

Preferably, said link is provided with a slot for receiving said first element, said slot being shaped to substantially prevent rotation of said first element within said slot.

Preferably, said locking means further comprises a stop for stopping rotation of the link about the first pivot connection in a second direction beyond a predetermined angular position relative to the lever, and biasing means for biasing said link to rotate in said second direction toward said predetermined angular position, whereby, upon said further movement, said lever operates to cause rotation of the link about said first pivot connection in a direction opposite said second direction away from said predetermined angular position to move said first element into engagement with said second element.

Preferably, said first and second elements comprise respective bearing surfaces configured so as to lock together upon mutual engagement.

Preferably, each bearing surface comprises first and second surface portions arranged so that when said locking means is in said locking state the first surface portions engage each other and the second surface portions engage each other.

Preferably, said first element comprises cam means on which said first and second surface portions are formed.

Preferably, said second element comprises an elongate slot cut in said handle extending in a direction substantially parallel to the direction of relative movement of the first and second jaws, and said first and second surface portions are formed on opposite longitudinal surfaces of the slot.

Preferably, said first surface portions are provided with mutually engagable teeth.

Preferably, the second surface portion of said cam means is curved.

Preferably, the second surface portion of said cam means is planar.

Preferably, said adjustable spanner further comprises a second bias means acting between said lever and said handle acting to bias said lever to pivot in a direction opposite said first direction and urge the locking means toward the free state.

BRIEF DESCRIPTION OF THE DRAWINGS

An embodiment of the invention can be described by way of example only, with reference to the accompanying drawings in which.

DETAILED DESCRIPTION OF THE PREFERRED EMBODIMENT

Figure 1:
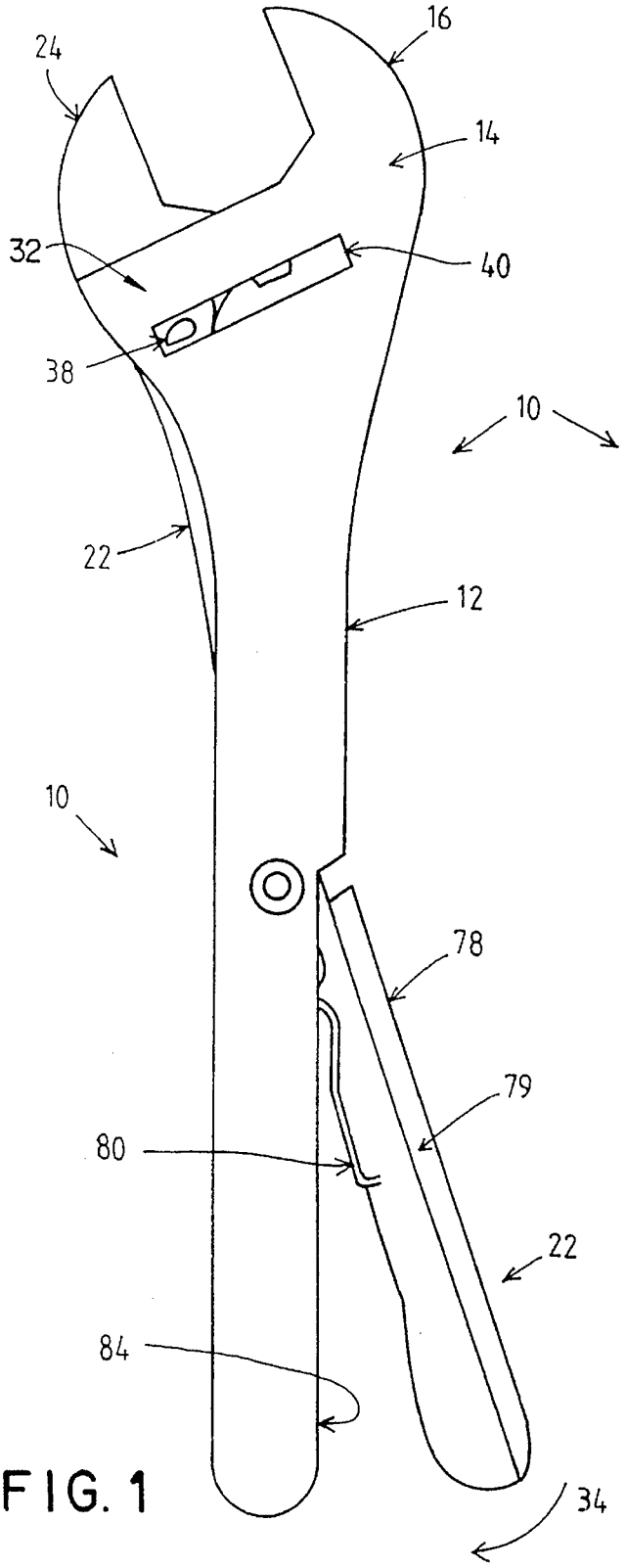
FIG. 1 is a front view of the adjustable spanner in a fully opened position.
Figure 3:
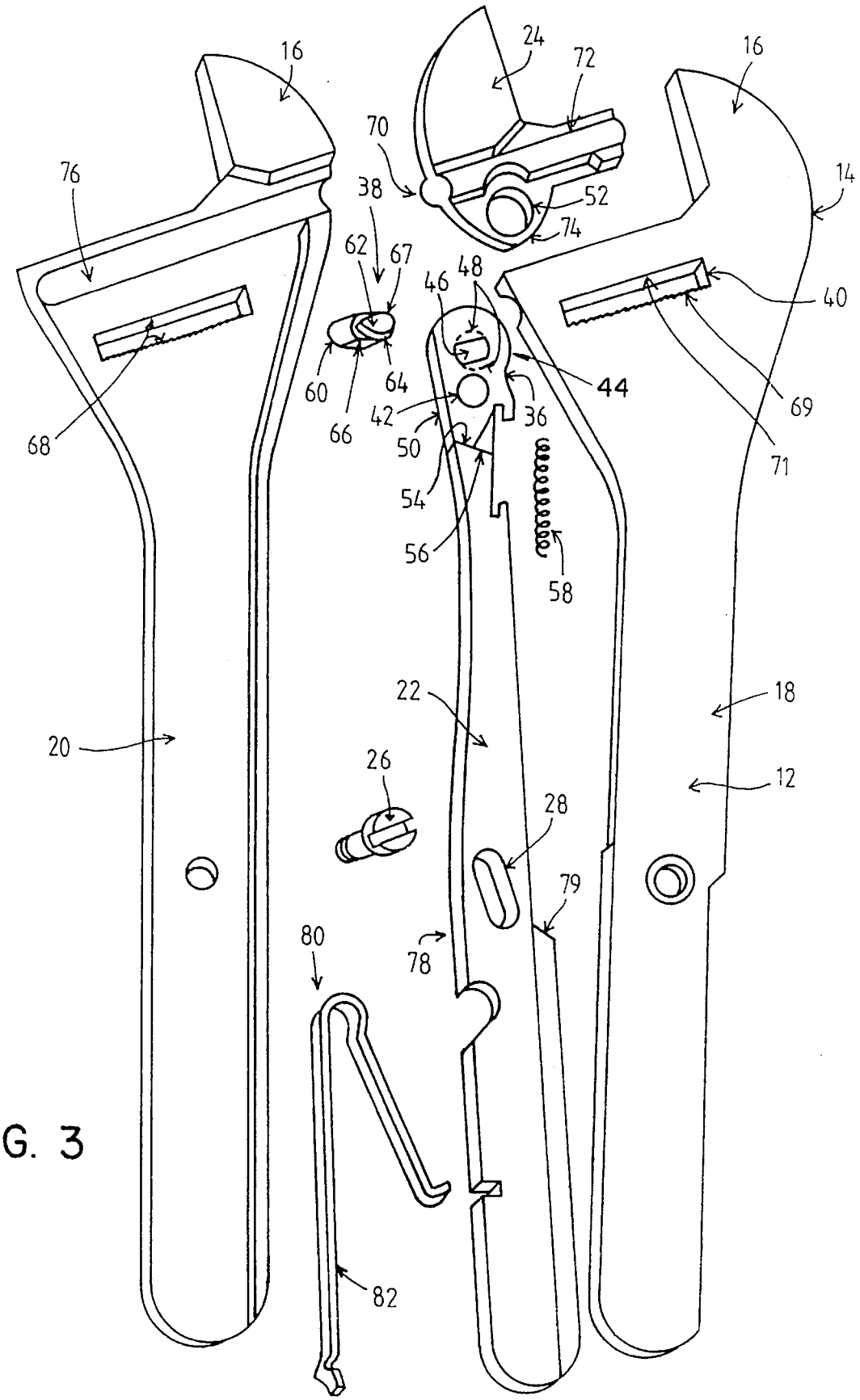
FIG. 3 is is an exploded view of the adjustable spanner.
Figure 4:
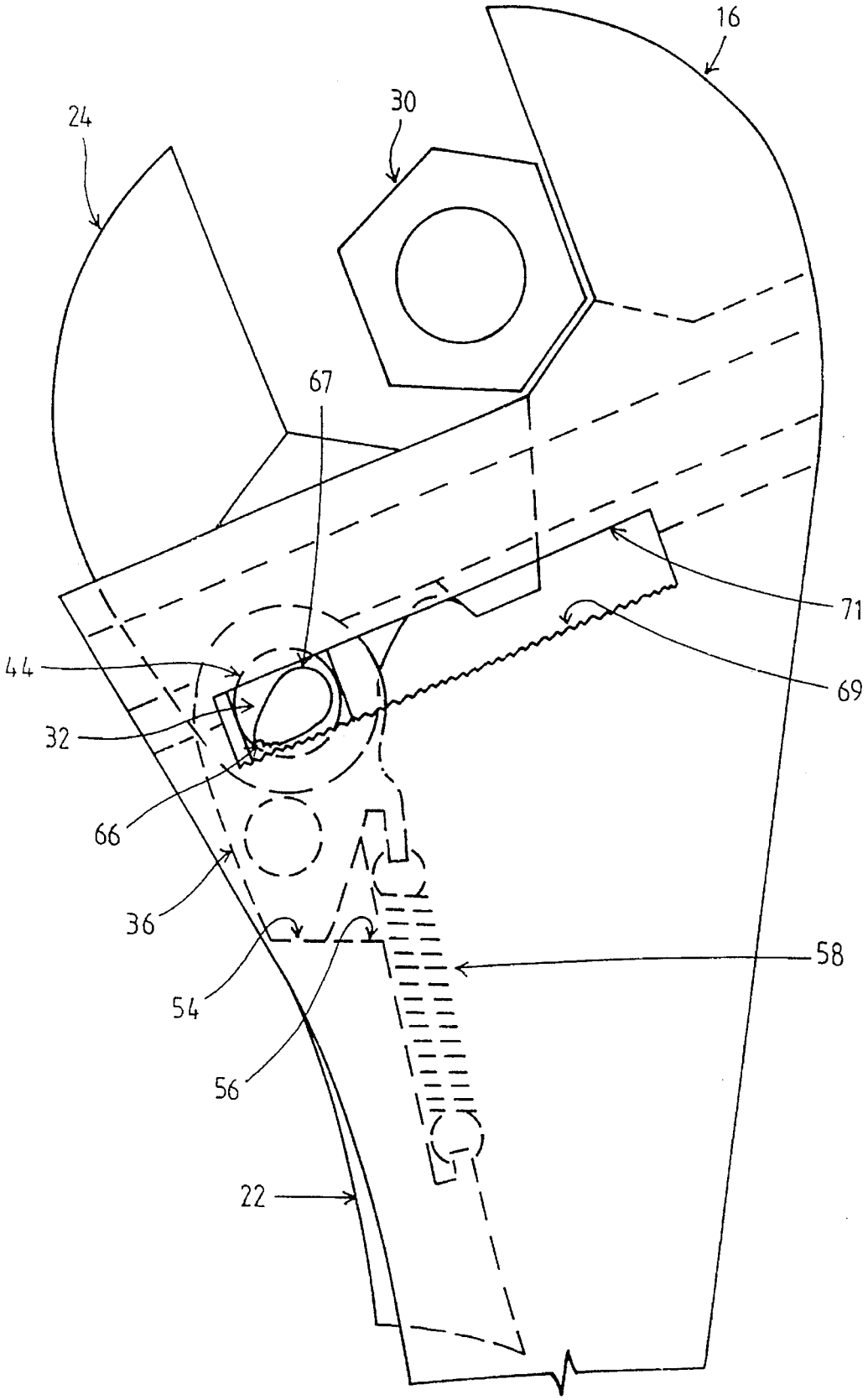
FIG. 4 is a front view of an upper portion of the spanner prior to engagement with a nut; and, FIG. 5 is a front view of an upper portion of the spanner upon engagement of a nut.
Figure 5:
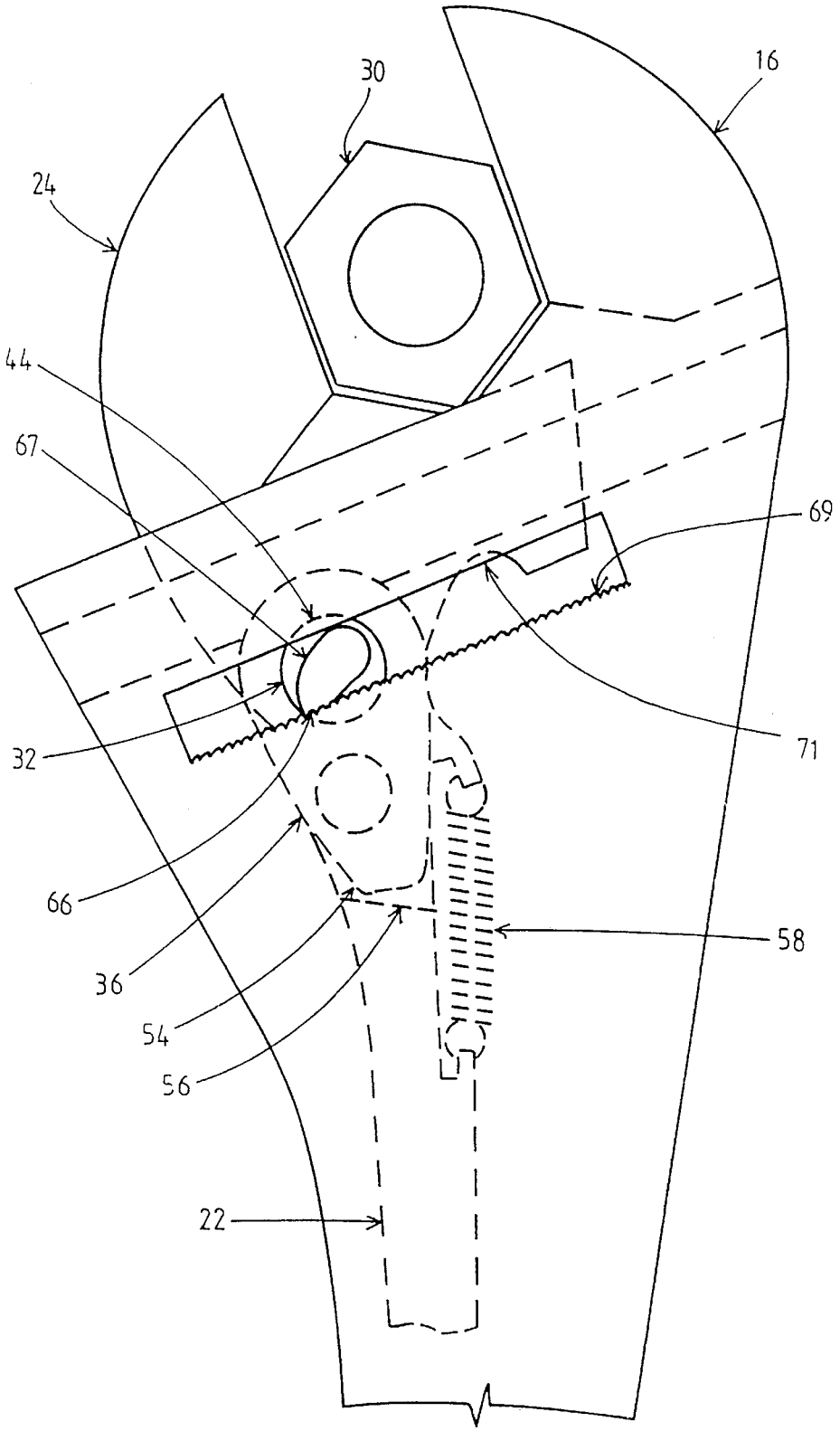

As shown in the accompanying drawings, an adjustable spanner 10 comprises a handle 12 having a head portion 14 at one end, the head portion being provided with a first jaw 16. In the present embodiment, the handle 12 is made of two complimentary halves 18 and 20 having matching features (refer FIG. 3). A lever 22 having a second jaw 24 coupled thereto at one end is pivotally connected to the handle 12 by means of a screw fastener 26 which threadingly engages the handle 12 and passes through an elongate slot 28 formed in the lever 22. The handle and lever are juxtaposed so that pivotal movement of the lever 22 relative to the handle 12 effects movement of the first jaw 16 relative to the second jaw 24 whereby the first and second jaws can grip an article such as a nut or bolt head 30 therebetween (refer FIGS. 4 and 5). The spanner 10 further includes a locking means 32 having a free state (shown in FIGS. 1, 2 and 4) in which the jaws 16 and 24 are able to move relative to each other, that is both away and toward each other, and a locking state, shown in FIG. 5, in which the jaws 12 and 24 are locked against movement away from each other. The locking means cooperates with the lever 22 so as to remain in the free state until the lever is pivoted in a first direction relative to the handle indicated by arrow 34 to a position where nut 30 is engaged between the jaws. Upon further movement of the lever in direction 34, the lever operates to change the state of the locking means to the locking state as shown in FIG. 5 thereby locking the jaws against movement away from each other.

The locking means 32 comprises a link 36 and first and second mutually engagable elements in the form of cam 38 and longitudinal slots 40, respectively. The link 36 has a first pivot connection 42 to the lever and a second pivot connection 44 to the second jaw 24. A slot 46 for receiving the cam 38 is formed in the link 36 at an end distant the lever 22. A projection 48 having an arcuate bearing surface extends from a back side 50 of the link 36 adjacent each longitudinal side of slot 46. The projections 48 are received in hole 52 formed in the jaw 24 to provide the second pivot connection 44.

An end of the link 36 opposite the slot 46 is provided with a stop 54 adapted to abut against a shoulder 56 formed in the lever 22 to prevent clockwise rotation of the link 36 beyond a predetermined angular position relative to the lever 22. A spring 58 is connected between the link 36 and lever 22 to bias the link 36 to rotate in the clockwise direction to the predetermined angular position where the stop 54 abuts the shoulder 56.

The cam 38 has a central body 60 with identical cam sections 62 extending from opposite sides. The central body 60 is of the shape complimentary to that of the slot 46 so as to substantially prevent rotation of the cam 38 within the slot 46. Each cam section 62 includes a bearing surface 64 a first portion of which is provided with a plurality of teeth 66. A second portion 67 of bearing surface 64 is curved.

One longitudinal slot 40 is formed in each halve 18 and 20 of the head portion 14 and extend in the direction substantially parallel to the direction of relative movement of the jaws 16, 24. The peripheral surface of slot 40 forms a bearing surface 68 for engagement with the cam 38. The lower longitudinal portion of bearing surface 68 is provided with a rack of teeth 69. The upper longitudinal portion 71 of the bearing surface 68 is a planar surface.

The cam sections 62 ride in the slots 68 when the handle is pivoted about screw fastener 26. Abutment of the cam sections 62 with ends of the slots distant the first jaw 14 limits the maximum distance between the jaws to that shown in FIG. 1.

The second jaw 24 includes a carriage 70 provided on opposite sides with longitudinal ribs 72 of arcuate cross-section shape. A lobe 74 through which the hole 52 is formed depends from the ribs 72. Obliquely extending grooves 76 are formed in the head portion 14 to receive the ribs 72 so as to key the second jaw 24 to the handle 18 for linear movement.

A lower portion 78 of the lever 22 is provided with an elongate flange 79 extending laterally from a side distant the handle 12. The flange 79 forms a bearing surface for the hand of a user when pivoting the lever 72 in direction 34. The lower portion 78 is shaped on a side opposite flange 79 for engaging one side of a hair-pin like spring 80. The spring 80 includes a leg 82 which abuts the interior of a side surface 84 of the handle 18. The spring acts to pivot the handle in a direction opposite that indicated by arrow 34 so that the jaws 16 and 24 are in the position shown in FIG. 1.

Figure 2:
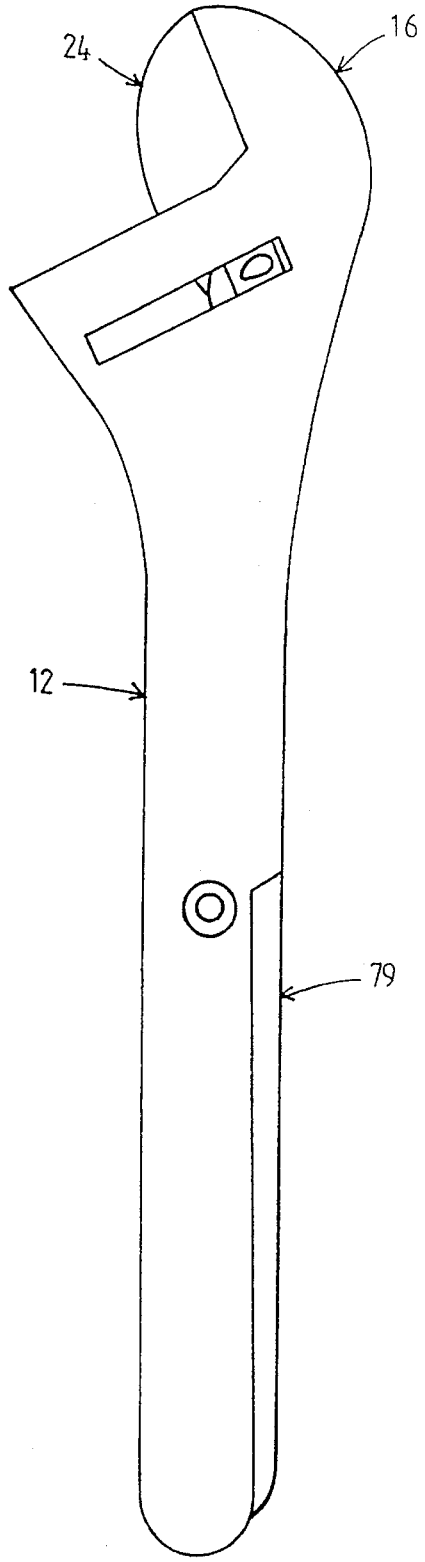
FIG. 2 is a front view of the adjustable spanner in a fully closed position.

The lever 22 moves within a cavity formed in the handle 12 between the halves 18,20. When the lever is pivoted in the clockwise direction relative to the handle to a position where jaws 16 and 24 meet the lower portion 78 is received in the cavity with flange 79 abutting the handle 12 as shown in FIG. 2.

The operation of the adjustable spanner 10 will now be described.

Prior to use, the spring 80 acts to bias the lever 22 in an anticlockwise direction about the screw 26 so that the distance between jaws 16 and 24 is at a maximum. The spring 58 biases the link 36 to a position where the stop 54 abuts the shoulder 56. When in this position, the bearing surface 64 of cam 38 is spaced above and disengaged from the rack 40. This corresponds to the locking means 32 being in the free state.

If the handle 22 is pivoted in clockwise direction 34 against the bias of spring 80, the second jaw is caused to slide in a linear path toward the first jaw 16 by virtue of the engagement of the ribs 72 in the grooves 76. The spring 58 holds the stop 54 against the shoulder 56 therefore maintaining the locking mechanism 32 in the free state (refer FIG. 4). Due to the inclination of grooves 76 the pivotal movement of the lever is accompanied by linear movement in the general direction of the length of the lever toward the first jaw 16. This linear movement is accommodated by virtue of the pivot connection 44 and slot 28. The locking means 32 remains in the free state during this movement until the nut 30 is gripped between the jaws 16 and 24.

Continued pivotal movement of the lever 22 in direction 34 causes the link 36 to rotate in an anticlockwise direction about pivot 42 against the bias of spring 58. Accordingly, the cam 38 is likewise rotated so that teeth 66 engage the teeth on rack 69, and portion 67 of bearing surface 64 abuts the upper longitudinal portion 71 of bearing surface 68 as shown in FIG. 5. The locking means 32 is now in the locking state and the jaws 16 and 24 are locked against movement away from each other. In this configuration the cam 38 and a particular cam sections 62 act as a wedge in slot 40. Provided the lever is maintained in this position relative to the handle, the spanner 10 can now be used to apply torque to the nut 30 in the desired direction for fastening or loosening. The reaction force to the applied torque on second jaw 24 acts on pivot connections 42 and 44 to urge the cam 38 to rotate in the anticlockwise direction to assist in the wedging action of cam 38.

When the handle 22 is released, spring 58 initially acts to rotate the link 36 in the clockwise direction to lift the cam 38 out of engagement with slot 40. The locking means 32 is now in the free state and the jaws 24 and 16 can move relative to each other. The spring 80 acts on the lever 22 to cause it to pivot in an anticlockwise direction thereby returning the spanner to the configuration shown in FIG. 1.

Now that an embodiment of the invention has been described in details, it will be apparent to those skilled in the relevant arts that numerous modifications and variations may be made without departing from the basic inventive concepts. For example, the handle 12 can be made from a single piece of cast and machined metal rather than separate halves 18, 20. In addition, the lever 22 can be shaped so that rather than extending through the handle 12 it is located exterior of the handle 12. This will avoid the need to form the handle with an internal cavity for accommodating the lever and may simplify manufacture. Furthermore, the second portion 67 of bearing surface 64 can be planar rather than curved to give greater area of contact with the upper longitudinal portion 71 of bearing surface 68 when the locking means is in the locking state. In the present embodiment the centre of rotation of the cam 38, which corresponds with the centre of slot 46, moves in a path substantially coincident with the longitudinal centre line of slot 40 as the lever is pivoted with respect to the handle. However, in an alternative form the centre of rotation of cam 38 can be offset from the longitudinal centre line of slot 40 towards the jaws 16, 24. This is most easily achieved by forming the slot 46 closer to the jaw 24. The effect of this, when the spanner is in use, is that a portion of the reaction force applied by jaw 24 creates torque on the cam 38 acting in the anticlockwise direction to further amplify the wedging effect of cam 38 in slot 40. All such modifications and variations are deemed to be within the scope of the present invention the nature of which is to be determined from the aforegoing description and the appended claims.

The claims defining the invention are as follows:

1. An adjustable spanner comprising:

a handle provided with a first jaw at one end;

a lever having a second jaw coupled thereto at one end, the lever being directly pivotally connected to the handle and juxtaposed so that pivotal movement of the lever relative to the handle effects movement of the second jaw relative to the first jaw whereby the first and second jaws can grip an article placed therebetween;

locking means having a free state in which the jaws are able to move relative to each other and a locking state in which the jaws are locked against movement away from each other, said locking means cooperating with said lever so as to remain in said free state until the lever is pivoted in a first direction relative to the handle to a position where the jaws grip an article placed between the first and second jaws, whereby, upon further movement in said first direction the lever operates to change the state of the locking means to the locking state, thereby locking said jaws against movement away from each other;

said locking means comprising first and second mutually engagable elements and a link having a first pivot connection to said one end of said lever and a second pivot connection to said second jaw thereby coupling said second jaw to said lever, said first element being carried in a slot provided in said link, the slot shaped to substantially prevent rotation of the first element within the slot, and said elements being disengaged when the locking means is in said free state and being engaged when the locking means is in said locking state, said first element associated with the lever so that upon said further movement, said lever operates to effect engagement of said first and second elements.

2. An adjustable spanner according to claim 1, wherein said locking means further comprises a stop for stopping rotation of the link about the first pivot connection in a second direction beyond a predetermined angular position relative to the lever, and biasing means for biasing said link to rotate in said second direction toward said predetermined angular position, whereby, upon said further movement, said lever operates to cause rotation of the link about said first pivot connection in a direction opposite said second direction away from said predetermined angular position to move said first element into engagement with said second element.

3. An adjustable spanner according to claim 2, wherein said first and second elements comprise respective bearing surfaces configured so as to lock together upon mutual engagement.

4. An adjustable spanner according to claim 3, wherein each bearing surface comprises first and second surface portions arranged so that when said locking means is in said locking state the first surface portions engage each other and the second surface portions engage each other.

5. An adjustable spanner according to claim 4 wherein said first element comprises cam means on which said first and second surface portions are formed.

6. An adjustable spanner according to claim 5, wherein said second element comprises an elongate slot cut in said handle extending in a direction substantially parallel to the direction of relative movement of the first and second jaws, and said first and second surface portions are formed on opposite longitudinal surfaces of the slot.

7. An adjustable spanner according to claim 6, wherein said first surface portions are provided with mutually engagable teeth.

8. An adjustable spanner according to claim 7 wherein the second surface portion of said cam means is curved.

9. An adjustable spanner according to claim 7, wherein the second surface portion of said cam means is planar.

10. An adjustable spanner according to claim 1, wherein said second jaw is keyed to said handle for linear movement relative to said first jaw.

11. An adjustable spanner according to claim 1, wherein said second jaw is keyed to said handle for oblique linear movement relative to said first jaw.

12. An adjustable spanner according to claim 1, further comprising a second bias means acting between said lever and said handle acting to bias said lever to pivot in a direction opposite said first direction and urge the locking means toward the free state.

* * * * *